US006898804B2

(12) United States Patent
Sandler

(10) Patent No.: US 6,898,804 B2
(45) Date of Patent: May 31, 2005

(54) SKI POLE GRIP AND GLOVE COMBINATION

(75) Inventor: Ronald A. Sandler, Chicago, IL (US)

(73) Assignee: Aplix S.A., Paris (FR)

( * ) Notice: Subject to any disclaimer, the term of this patent is extended or adjusted under 35 U.S.C. 154(b) by 0 days.

(21) Appl. No.: 10/340,771

(22) Filed: Jan. 9, 2003

(65) Prior Publication Data

US 2004/0133965 A1 Jul. 15, 2004

(51) Int. Cl.[7] ..... A41D 19/00
(52) U.S. Cl. ..... 2/161.1; 2/169
(58) Field of Search ..... 2/16, 20, 158, 2/159, 160, 161.1, 161.2, 161.3, 161.6, 163; 473/205, 300

(56) References Cited

U.S. PATENT DOCUMENTS 3,368,811 A * 2/1968 Finney ..... 473/300
3,508,280 A * 4/1970 Osborn ..... 2/159
3,532,344 A * 10/1970 Masstab ..... 473/205
4,653,121 A * 3/1987 Kassal et al. ..... 2/160
4,665,565 A * 5/1987 Odom ..... 2/161.2
4,691,387 A * 9/1987 Lopez ..... 2/161.3
4,698,851 A * 10/1987 Dunford et al. ..... 2/160
5,373,138 A * 12/1994 Locklear et al. ..... 219/121.69
5,656,226 A 8/1997 McVicker
5,887,282 A 3/1999 Lenhart
5,997,039 A 12/1999 Manninen
6,224,364 B1 5/2001 Harvey
6,233,743 B1 5/2001 Cummins
RE37,338 E 8/2001 McVicker
6,386,588 B1 5/2002 Young et al.

* cited by examiner

*Primary Examiner*—Gary L. Welch
(74) *Attorney, Agent, or Firm*—Jones Day

(57) ABSTRACT

A pole grip and glove combination that uses a hook material on at least a portion of the grip with a corresponding mating loop material on at least a portion of the palm of a glove such that when the user grasps the grip at the pole end while wearing the glove, the hook and loop material engage and releasably attach the glove to the pole grip.

8 Claims, 2 Drawing Sheets

SKI POLE GRIP AND GLOVE COMBINATION

BACKGROUND OF THE INVENTION

1. Field of the Invention

The present invention relates, in general, to an improved and economical method and apparatus permitting a skier to grasp the grip of a ski pole by using a grip having integrally formed hooks thereon and a glove having loop material thereon so that when the glove touches the ski pole grip, the ski pole and the glove are removably attached to each other.

2. Description of Related Art

It is, of course, well known that skiers use ski poles to both help maintain their balance and for timing turns during skiing. Similarly, hikers also use walking sticks for balance purposes. Traditionally, the ski or walking poles are made of metal or other material and are provided at one end with a shaped grip, usually formed of a resinous material. Typically, the grip is provided with a relatively large loop or strap of some material, such as perhaps leather, cloth, or flexible plastic attached at one or more places to the grip. The user inserts a gloved hand through the strap (or first inserting the bare hand and then putting the glove on afterwards) then the user may grasp the pole grip during use. For years, a single point attachment strap loop arrangement was found to be desirable. However, this system did not provide firm support for the skier's gloved hand unless the strap loop was adjusted snugly around the hand. However, such snug adjustment would make the strap loop difficult to enter and exit. This is frequently done when either a skier falls or is getting ready to enter a chair lift and the ski poles must be removed from the skier's hand and wrist.

Various patents depict devices providing for adjustability of the straps and loops to enable the skier to more easily remove the hand from the ski grip strap but in many instances, the strap then is too loose to adequately support the skier's hand on the grip. Straps are difficult to get into, especially on cold days when one does not wish to remove a glove or mitten, but they also may tend to increase the likelihood of injury as the ski pole continues to be held to the skier's wrist during a fall, particularly thumb injuries. The use in certain devices of a clip type mechanism also can be inefficient because it requires difficult alignment and may require the free hand; it also can create problems if snow or ice forms in the clip receiving receptacle during periods when the clip is separated from the ski pole grip.

Examples of complex strap and buckle arrangements for this purpose are found, for example, in U.S. Pat. Nos. 5,997,039 and 6,386,588. Also, there has been patented a more complex mitten arrangement provided with multiple straps to secure a handicapped person's hand to a ski pole, one such device being illustrated, for example, in U.S. Pat. No. 6,233,743. Another version of a glove with an integrated hand loop wherein the loop snaps into the pole grip, is illustrated in U.S. Pat. No. 5,887,282. All of these devices are costly and are complex to make and suffer from various inefficiencies.

Another alternative arrangement in lieu of a strap includes the use of a C-shaped type grip in which the hand fits inside C-shaped members formed integrally with the grip and which permit the hand to easily slide into the grip and which are sufficiently flexible to enable the hand to "pop out" during a fall. However, even in those instances, because of the different types of gloves and mittens and the size of the skier's hand, such devices are not universally effective in holding the hand firmly on the grip.

It, therefore, is advantageous to provide means which will permit relatively secure attachment of a glove or mitten (hereinafter the term "glove" will be used generically, except where clear otherwise, to cover both gloves and mittens) of the user to the ski pole grip and without the use of a strap, C-shaped grips, or snap receiving receptacle. In addition, the present invention permits the use of a formed grip that is universal and can be used with either the right or left hand and with other advantageous features that are normally found in formed grips. For example, forming a platform at the bottom of the grip handle to partially support the heel of the skier's gloved hand, or a knob-like surface at the top of the grip for use in lifting and/or hand alignment.

Another advantage of the present invention is that the ski pole grip system is universal, meaning that it is not necessary to produce a separate right hand grip and left hand grip. The present invention permits integrally forming the hook arrangement on various locations on the grip during grip formation so as to provide adequate support for the right or left hand palm of the user.

It has been known to use hook and loop type fastening means for various purposes in the sportswear field, including in the skiing area. For example, the top strap of ski boots frequently is provided with hook and loop fasteners in order to tighten the very most uppermost cuff portion of the boot at which no buckle is placed. Hook and loop type fasteners also have been used to fasten shoes and for other purposes. To applicant's knowledge, however, such devices that are attached to an object require either the use of an adhesive and/or a method of sewing or welding a portion of the hook or loop material to the object.

In the case of a ski pole grip, such hook and loop arrangements heretofore have not been deemed feasible for various reasons. First, fastening a flexible strip of hook-like material by an adhesive to a relatively rigid grip is likely to result in separation due to the significant differences in coefficients of expansion of the materials and the wide temperature differentials to which the grip is exposed. Moreover, the high friction caused by grasping or pushing on the grip also is likely to cause shear movement of the strip of hook material, if adhesively fastened. Moreover, it is not feasible to stitch a patch of hook material to the ski pole grip. The same disadvantages of course apply if the loop material were adhesively affixed to the grip.

Applicant is aware that there has been and patented and used, a technique by which a field of injection molded hooks is formed during the injection molding process of a larger relatively rigid resinous element. Such techniques are disclosed in detail, for example, in U.S. Pat. Nos. 5,656,226 and RE 37,338, the disclosures of both of which are incorporated in full herein by reference.

While the present invention most advantageously employs integral molding of the hooks as part of the molding of the grip, it will be understood that though not as efficient and less likely to be as durable, existing ski pole grips may be retrofitted with strips of hook material adhesively applied, permitting continued use of the gloves having the loop material thereon with different ski poles not purchased as part of a system.

The loop material preferably is attached to at least a portion of the fingers or palm of the glove as desired. If the glove is in the form of a mitten without fingers, the loop material is attached to an upper portion of the palm and may be attached to a portion of the general finger area as desired. While the hook material could be placed on the glove, because it has a tendency to attach to other materials, it would be undesirable to have the glove inadvertently attaching to other materials and, therefore, desirably the loop material would be attached to the glove palm surface. Also because the loop material is relatively soft, it will not be abrasive if a user brushes snow or the like off of their face without removing a glove.

In addition to minimizing the cost of installation by integrally forming the hooks directly onto the pole grip during manufacture of the grip, another advantage of the present invention is the capability to provide the hooks on various locations, on the side or rear surfaces of the ski pole grip, thereby permitting use by either the right or left hand. The location is limited only by other surfaces that the manufacturer employs for other purposes. The present invention is particularly useful for children and novice skiers who are just learning to use skis and poles and frequently have difficulty in both getting hands through the prior art strap arrangements, as well as maintaining control of the poles with mittens. Similarly, the loop material, instead of being fixedly secured to the glove, may be formed on a tub or outer sleeve that slides over the glove surface, with cutouts for the thumb and/or fingers to pass through.

The present invention not only provides a quick and easy method of providing sufficient gripping connection between the skier's hand and the pole, but at the same time, permits an easy breakaway from the pole during a fall, as typically the tension required to separate hook and loop fasteners is significantly smaller than the amount of force that would cause injury.

Therefore, it is a principle object of the present invention to provide a pole grip that will remain attached to the glove of a user without use of a strap.

It is a further object of the present invention to utilize hook and loop materials, with the hook material being associated with the pole grip and mating loop material associated with the user's glove such that when the user grabs the pole the grip is removably adhered to the user's glove.

It is a primary object of the invention to integrally form the hook material at one or more locations on the pole grip during the manufacture of the grip. Thus, the present invention relates to a pole and glove combination comprising a pole having a grip thereon; a field of hook materials associated with a portion of the grip and a glove having a loop material associated therewith for engaging the hook material on the grip, whereby the loop material will matingly engage the portion of the hook material associated with the grip when the user's glove grasps the grip.

BRIEF DESCRIPTION OF THE DRAWINGS

These and other more detailed objects of the invention will be disclosed when taken in conjunction with the following detailed description of the invention in which like numerals represent like elements and, in which.

DETAILED DESCRIPTION OF THE DRAWINGS

Figure 1:
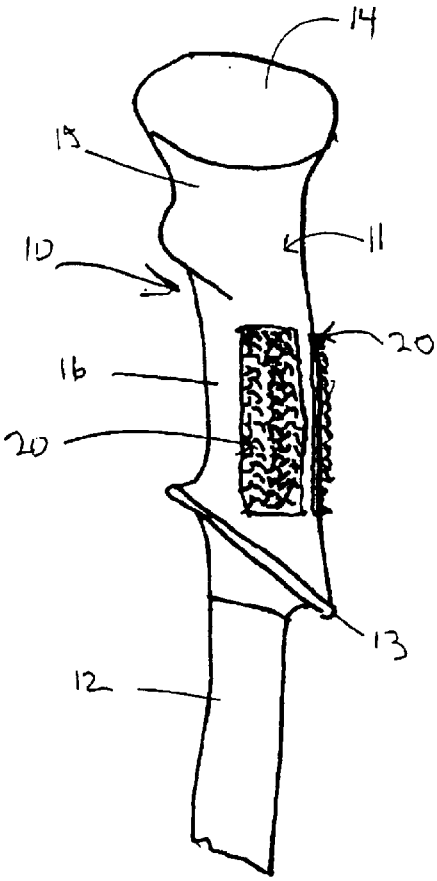
FIG. 1 is a perspective view of one form of grip on a pole, having fields of hooksintegrally formed on sections thereof.

FIG. 1 is an isometric view of a portion of common ski pole that has an upper portion on which a grip of the present invention is secured.

While a ski pole grip has been used herein, it will of course be understood that the present invention could be used with any type of poles, such as cross-country poles, hiking sticks, walking sticks, or the like, that may have a surface that defines a grip area, and where the user typically also will use a glove.

For purposes hereof, a ski grip will be described. With reference to FIG. 1, typically the grip 10 consists of an elongated handle portion 11 having a hollow cylindrical center opening at its lower end (not shown). A pole shaft 12 extends into the hollow interior area of the handle 11 and is snugly engaged therein to retain the grip 10 on the pole shaft. The length of the handle will vary from standard lengths to accommodate a wide range of sizes and typically will include a heel portion on the bottom ridge 13 of the handle 11 so as to prevent total downward slippage of the skier's hand and also to provide some leverage especially during poling. Similarly, the top of the grip 10 is provided with an enlarged knob-like area 14 to ensure proper placement of the hand on the grip between ridge 13 and the knob 14. The knob 14 also provides an area for grasping the very top of the pole by the user's palm when, for example, it is desired to obtain additional leverage during poling as on flat or trail areas. It also provides a convenient location for strap attachment.

There are a wide variety of grips made by various manufacturers that have different configurations, for example, such as in U.S. Pat. No. 5,887,282, providing areas where the index finger engages one upper portion 15 of the grip 10 and the remaining fingers engage another portion 16 of the grip. This seems to provide a natural comfort fit for the hand permitting more control over movement of the pole.

The bulbous upper area or knob 14 also serves as a platform which urges the ski pole grip upwardly as the skier's hand goes through upward motion during skiing or otherwise for moving the pole in an upward direction. The specific shape of the grip 10 does not form part of the present invention, provided the grip has at least one or more areas in which a field of hooks 20 may be integrally formed thereon during the molding process.

Thus, for example, for greater universality, the fields 20 of hooks may be formed on both sides and the rear surface of the handle (one side and rear being shown for illustrative purposes only). Part of this will be dictated by the size of the hook field and its ease in formation. In use, the palm tends to grasp one side of the grip handle and the finger area wraps to the opposite side, so there may be little need for a field of hooks on the grip's rear face.

As presently understood, there are desirable methods of integrally forming the hooks, for example, as illustrated in U.S. Pat. No. RE 37,338. It will be apparent from that patent that hooks may be formed in a curved surface (in that case the hooks are be molded into a curved plane forming a part of an orthopedic device). It also will be understood that, for example, the hooks may be formed of a first material different than underlying grip handle, during the forming of the grip as illustrated and disclosed for example in other patents such as U.S. Pat. No. 6,224,364, incorporated herein in full by reference.

Figure 4:
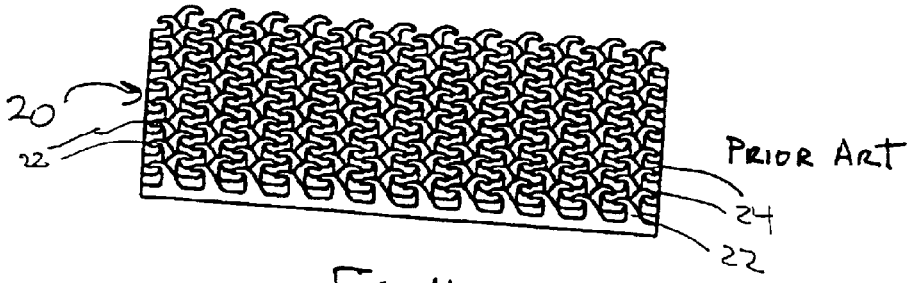
FIG. 4 is a perspective view of a field of hooks of the type which may be integrally formed on the grip of FIG. 1.

FIG. 4 illustrates one example of one type of hook arrangement and structure which may be employed. FIG. 4 is similar to FIG. 9 of U.S. RE Pat. No. 37,338. In this case, single tip hooks arranged in oppositely facing adjacent rows 22 and 24 are provided.

Other shapes of hooks that are sufficiently flexible to be integrally formed or in which different techniques for molding the hooks into the grip may be used and still provide a field of hooks useful in the present grip and glove system. Hooks having slightly different shapes, or in which a single hook has tips facing in both directions, or hooks in which alternate direction in different fields or sections may be utilized, the present invention not being limited to the precise shape of hook, nor the particular array of hooks formed in the grip.

Figure 2:
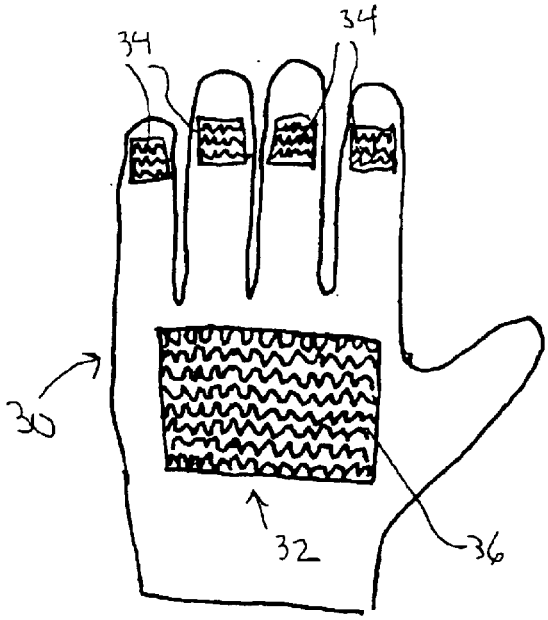
FIG. 2 is a plan view of a glove that has a field of corresponding mating loop material attached to a portion of the palm and fingers thereof for matingly attaching to the hooks on the pole grip.
Figure 3:
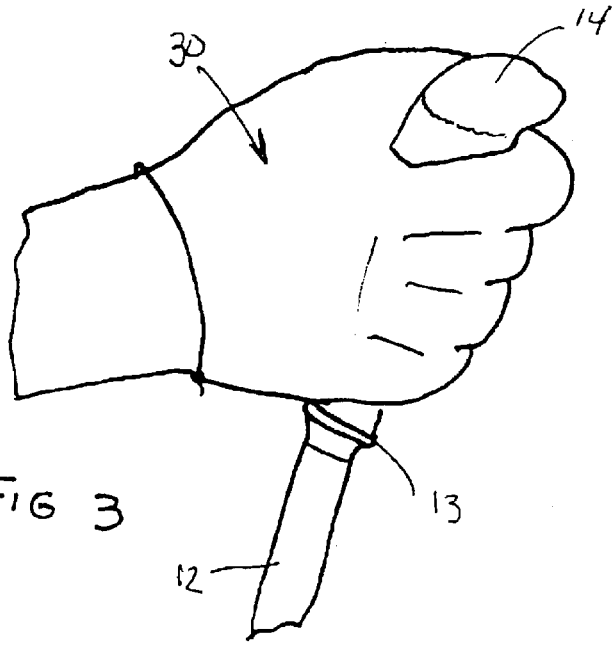
FIG. 3 is a perspective view of the glove of FIG. 2 releasably grasping the pole grip of FIG. 1.
Figure 5:
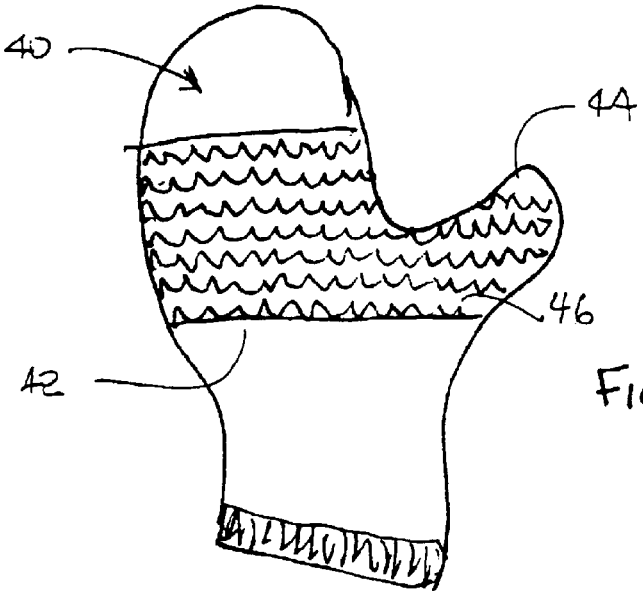
FIG. 5 is a plan view of a mitten with a strip of loop material that is attached to the palm side and a portion of the thumb area.
Figure 6:
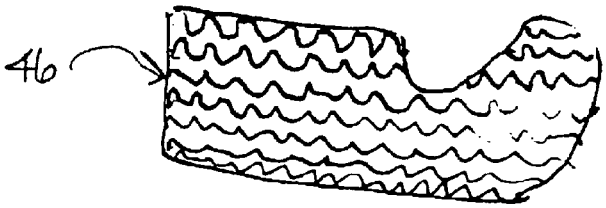
FIG. 6 is a plan view of a sleeve of loop material that may be attached to a portion of the mitten palm and thumb areas as shown in FIG. 5.

Illustrated generically in FIGS. 2, 5 and 6 are a glove 30 and a mitten 40 in which the mating loop material will be secured, preferably by sewing a strip of loop material 36 to the glove 30 or to the mitten 40. Because in this instance the glove 30 itself is flexible as well as the loop material, there is less chance of the material being disconnected simply by temperature differentials. In an alternate construction (FIG. 6) the loop material may be formed on a tube or sleeve that fits over the glove or mitten, permitting use with existing gloves. In such cases, the sleeve would have cutouts for thumb and fingers to pass through for proper placement.

In FIG. 2 there is illustrated a glove 30 having mating loop material 34 and 36 attached to at least sections of the finger portions and/or the palm area 32. Some of the locations will be dictated by the size of the glove.

In FIG. 5 there is illustrated a mitten having a single enclosed finger portion 44 and an enclosed palm portion 42. The strip or field of the loop material 46 is placed across at least a portion of the thumb portion and the palm portion 42, although it may be desirable to avoid the thumb area to permit quicker disengagement in a fall. When the hand is in the mitten and wrapped around the mating areas of the grip, the mitten will be removably adhered to the ski pole grip because of the well known inner engagement of the mating hook and loop materials. Children tend to use mittens rather than gloves and their gloves have such small finger areas that it may be difficult to provide adequate contact surface area between the hooks and the mittens portion.

As previously noted, the hooks preferably are formed in accordance with the disclosures of U.S. Pat. No. 5,656,226 and U.S. RE Pat. No. 37,338 incorporated in full by reference. Both of these patents related to a method and tool and product for injection molding a thermoplastic device wherein a field of injection molded hooks is integrally formed in predetermined areas on the device during the injection molding of the device itself. It is disclosed in those patents that the hooks have a reduced radius from that of prior hooks and a changed geometry for promoting ejection during the injection molding process yet still maintaining the desired fastening function. In those devices the hooks comprise spaced rows of hooks with adjacent rows of hooks facing in the opposite direction. While the hook material disclosed therein is preferably polypropylene, other thermoplastics that could be used would include polypropylene, polyethylene, polystyrene, nylon and other semi-flexible thermoplastics. Similarly, slightly different hook designs may be employed depending on the application and nature of the woven, non-woven and knitted loop material used for engagement. Thus, it is well known in that field that hooks can range from both aggressive to low tack as required.

One example of polypropylene can be an unfilled blend of 50% homopolymer and 50% copolymer having a flex modulus from 130,000 to 150,000 psi. Another suitable polypropylene material is sold by Washington Penn Plastics Company of Washington, Pa. as product PPC3CF1, having a melt flow index of 11.6 g/10 min.; a notched Izon impact strength of 3.1 ft-lbs./in., a tensile strength of 3000 psi, and a flex modulus of 163,300 psi.

Molding the hook first directly into the grip 10 rather than fastening it with a separate material also improves the aesthetics of the grip, as the field of hooks will be formed of the same color and blend into the design of the grip. This, of course, would not be the case if a separate strip of hook material is adhesively secured to the handle 11 as the grips today are formed of a variety of colors and styles and it would not be economical to produce strips of hook material in multiple colors that matched the wide variety of grip colors currently promoted.

Thus, there has been disclosed a novel method and apparatus for removably attaching a glove to a pole grip permitting ease of release and without the use of a large loop around the grip or other cumbersome or expensive devices employing clips, cams or buckles. This novel arrangement is accomplished by using a hook material preferably integrally formed with the grip and a loop material placed on at least a portion of the palm area of a glove such that when the user grasps the grip the hooks thereon will matingly engage with the loop portions on the glove and yet being relatively easily releasable therefrom. It will be understood that a conventional loop strap could also be employed with grips of the present invention, as the strap may provide other useful functions.

While the invention has been described in conjunction with a preferred embodiment, it will be obvious to one skilled in the art that other objects and refinements of the present invention may be made with the present invention within the purview and scope of the present invention.

What is claimed is:

1. A ski-pole grip and glove combination comprising:

at least one ski pole having a grip thereon for engagement by the hand of a user;

a field of semi-flexible hook material integrally formed in said thermoplastic material in a portion of said ski pole grip; and at least one glove having a field of loop material associated therewith in an area comprising the inner surface of the palm or finger thereof such that said loop material will matingly engage said hooks on said ski pole grip when the user's glove grasps said ski pole grip such that said ski pole grip is removably engaged with the glove during use.

2. The combination of claim 1 wherein:

said ski glove has individual finger portions and a palm portion; and said loop material is placed upon at least a portion of either said finger portins or said palm portion of said glove.

3. The combination of claim 1 wherein:

said ski glove is a mitten having a single enclosed space for the hand, including the fingers and the palm; and said loop material is attached to at least a portion of said mitten over said enclosed space such that it can grip the hook material on said ski pole grip.

4. The combination of claim 1 wherein said loop material is provided on an overlayer that is removably positioned on said ski glove.

5. A method of retaining a ski pole in the hand of a user comprising the steps of:

providing a ski pole having a thermoplastic grip theron and a field of intergrally formed hooks providing a ski glove for a user, said glove having an associated mating loop material such that when the user grasps the upper end of the ski pole with said glove, said field of hooks on said ski pole grip is releasably attached to said associated mating loop material on said glove.

6. A thermoplastic grip for use on a ski pole, wherein said grip has a generally defined area to be grasped by a user wearing a glove; said grip having at least one field of hooks integrally formed therein and adapted to engage an area of loop material on an associated glove.

7. The grip of claim 6, wherein said hooks are formed in fields, with at least one field formed on the side of said grip.

8. The grip of claim 6, wherein at least two field of hooks are formed on opposite sides of said grip.

* * * * *